US006626396B2

(12) United States Patent
Secker

(10) Patent No.: US 6,626,396 B2
(45) Date of Patent: Sep. 30, 2003

(54) METHOD AND SYSTEM FOR ACTIVE LASER IMAGERY GUIDANCE OF INTERCEPTING MISSILES

(75) Inventor: Arnon Secker, Givat-Ela (IL)

(73) Assignee: Rafael-Armament Development Authority Ltd., Haifa (IL)

( * ) Notice: Subject to any disclaimer, the term of this patent is extended or adjusted under 35 U.S.C. 154(b) by 0 days.

(21) Appl. No.: 10/004,864

(22) Filed: Dec. 7, 2001

(65) Prior Publication Data

US 2002/0080061 A1 Jun. 27, 2002

(51) Int. Cl.[7] ..... F41G 7/00; F42B 15/01

(52) U.S. Cl. ..... 244/3.16; 244/3.13; 244/3.15; 244/3.17; 342/52; 342/53; 342/54; 342/61; 342/62; 342/68; 342/176; 342/179; 342/195; 356/4.01; 356/5.01; 356/5.03; 356/5.04

(58) Field of Search ..... 244/3.1, 3.15, 244/3.16–3.22; 102/204, 211, 212–214; 342/61–68, 52–58, 175, 195, 176, 179, 189, 190, 191; 356/4.01–5.15

(56) References Cited

U.S. PATENT DOCUMENTS

| | | | | | |
|---|---|---|---|---|---|
| 4,324,491 | A | * | 4/1982 | Hueber | 244/3.16 |
| 4,898,341 | A | * | 2/1990 | Terzian | 244/3.16 |
| 5,626,311 | A | * | 5/1997 | Smith et al. | 244/3.16 |
| 5,877,851 | A | | 3/1999 | Stann et al. | |
| 5,940,170 | A | | 8/1999 | Berg et al. | |
| 6,196,497 | B1 | * | 3/2001 | Lankes et al. | 244/3.17 |

* cited by examiner

*Primary Examiner*—Bernarr E. Gregory
(74) *Attorney, Agent, or Firm*—Mark M. Friedman

(57) ABSTRACT

A method for guiding an intercepting missile to a body-to-body contact with an airborne target in the atmosphere. The method includes the steps of guiding the intercepting missile to within an appropriate distance from the airborne target, illuminating the airborne target, using an illuminator carried by the intercepting missile, acquiring an image of the illuminated airborne target and, steering the missile in accordance with an aimpoint on the image.

65 Claims, 2 Drawing Sheets

METHOD AND SYSTEM FOR ACTIVE LASER IMAGERY GUIDANCE OF INTERCEPTING MISSILES

FIELD AND BACKGROUND OF THE INVENTION

The present invention relates to a target acquiring mechanism of intercepting missiles in general and to their last stage of homing on target in particular.

It is known that most hit attempts of intercepting missiles did not end in a direct hit on target. This is so for mainly two reasons: Firstly the intercepting missile may be diverted from its flight path to target by decoy countermeasures which are deployed by the target (such as flares for infra-red seeking missiles or chaff for missiles equipped with radar), or as a result of artifacts such as sunlight reflection in case of an infra red seekers and spurious RF echo signals in the case of missiles equipped with radar.

Secondly; even in apparently favorable situations in which the missile is heading toward a valid target, present guiding mechanisms of both infra-red and radar seeker missiles can not handle unexpected fast angular changes between the momentarily missile heading direction and the direction to target which result whenever the latter performs an emergency-breaking maneuver.

For a specific example of missile's equipped with infrared seeking sensors the process of updating the missile's flight path is as follows:

At the time after missile launching the sensor is directed substantially towards the target so that an infrared radiating "hot" spot of the target is located at, or near, the center of its field of view. As the target moves away from the center of the field of view of the missile's sensor so that the missile's flight path correspondingly moves off target, the sensor rotates independently of the missile's body to bring the target's infrared radiating hot spot back into the center of its field of view. A signal representative of the spatial rotation angle through which the sensor rotated during this maneuver is transmitted to a control unit which in turn operates the missile's steering system which, by way of a non-limiting example, activates the missile's control surfaces to change the missiles trajectory according to the guidance law.

This procedure of rotation of the missile's sensor and re-aligning of the missile has to be performed continuously, or quasi-continuously, since a missile cannot make sudden changes in direction, i.e., its flight path is always smooth, even though the missile's sensor is fitted on gimbals that allow for fairly large angles of rotation.

The process involved in updating an air-to-air missile equipped with a radar system is similar, the main difference being that in this case the target is maintained at the center of the field of view of the radar's antenna by maintaining a maximum target echo as received by the radar system.

A third possibility for primary guiding an intercepting missile toward a target is by the use of a data link system that obtains continuously data, which was acquired out side the missile, representative of target flight performance. It is obvious that also data link guidance cannot respond adequately to fast maneuvers of the target from short range.

As a result of the aforementioned reasons, an intercepting missile and an airborne target seldom reach a body-to-body contact. Hence intercepting missiles are equipped with a proximity fuse, which detonates the missile's warhead when the distance between the missile and the target has reached a small predetermined value, and the target is mainly affected by the blast, debris and fragments of the exploding warhead.

A detailed description of the damaging mechanisms of different warheads is given in the book "Conventional Warhead Systems Physics and Engineering Design" by Richard M. Lloyed, Published by the American Institute of Aeronautics and Astronautics, Inc. 1998.

A conclusion of this text is that unless a direct hit on target is achieved, the lethality of a missile can not be guarantied, because only in direct hit, a sufficient enormous amount of kinetic energy and momentum is imparted from the colliding bodies to the target so the target will be "pulverized". The realization of this "hit to kill" concept is especially important when the target is a ballistic missile carrying an unconventional payload.

This is the reason that "hit to kill" is considered vital to any one of various defense programs such as e.g. the U.S. National Missile Defense (NMD) program.

However the "hit to kill" concept has not yet been implemented to intercepting missiles operating in the lower atmosphere, e.g. such as an air to air missiles launched by an aircraft.

It is therefore desired to have a method and a system which will provide the "hit to kill" feasibility to intercepting missile operating in the low atmosphere.

SUMMARY OF THE INVENTION

The present invention describes an intercepting missile which is equipped with an active imagery laser system which enables the missile to score a direct hit, and method of operation thereof.

Consequently the warhead of the intercepting missile and its activation mechanism may become redundant, a fact which will lead to cheaper and more reliable intercepting missiles.

In accordance with the present invention there is provided a method for guiding an intercepting missile to a body-to-body contact with an airborne target in the atmosphere, the method comprising the steps of: (a) guiding an intercepting missile to within an appropriate distance from the airborne target; (b) illuminating the airborne target, using an illuminator carried by the intercepting missile; (c) acquiring an image of the illuminated airborne target and, (d) steering the missile in accordance with an aimpoint on the image of the airborne target.

In accordance with the present invention there is provided an active imagery guidance system mounted on an intercepting missile for guiding the intercepting missile to a body-to-body contact with an airborne target in the atmosphere, the system comprising: (a) an active imagery system to acquire an image of an airborne target; (b) a mechanism to calculate an aimpoint on the image and, (c) a steering mechanism to steer the intercepting missile in accordance to the aimpoint.

In accordance with the present invention there is provided a hit to kill airborne target intercepting missile operating in the atmosphere comprising of: (a) a primary guidance system to guide the intercepting missile to within an appropriate distance from an airborne target; (b) an active imagery guidance system to guide the intercepting missile to a body-to-body contact with the airborne target.

In accordance with the present invention there is provided a hit to kill airborne target intercepting missile system operating in the atmosphere comprising: (a) a launching sub system to launch the intercepting missile; (b) a primary guidance system to guide the intercepting missile to within an appropriate distance from an airborne target and, (c) an active imagery guidance system to guide the intercepting missile to a body-to-body contact with said airborne target.

Other objects and benefits of the invention will become apparent upon reading the following description taken in conjunction with the accompanying drawings.

BRIEF DESCRIPTION OF THE DRAWINGS

The invention is herein described, by way of example only, with reference to the accompanying drawings, wherein.

DETAILED EMBODIMENTS OF THE INVENTION

Figure 1:
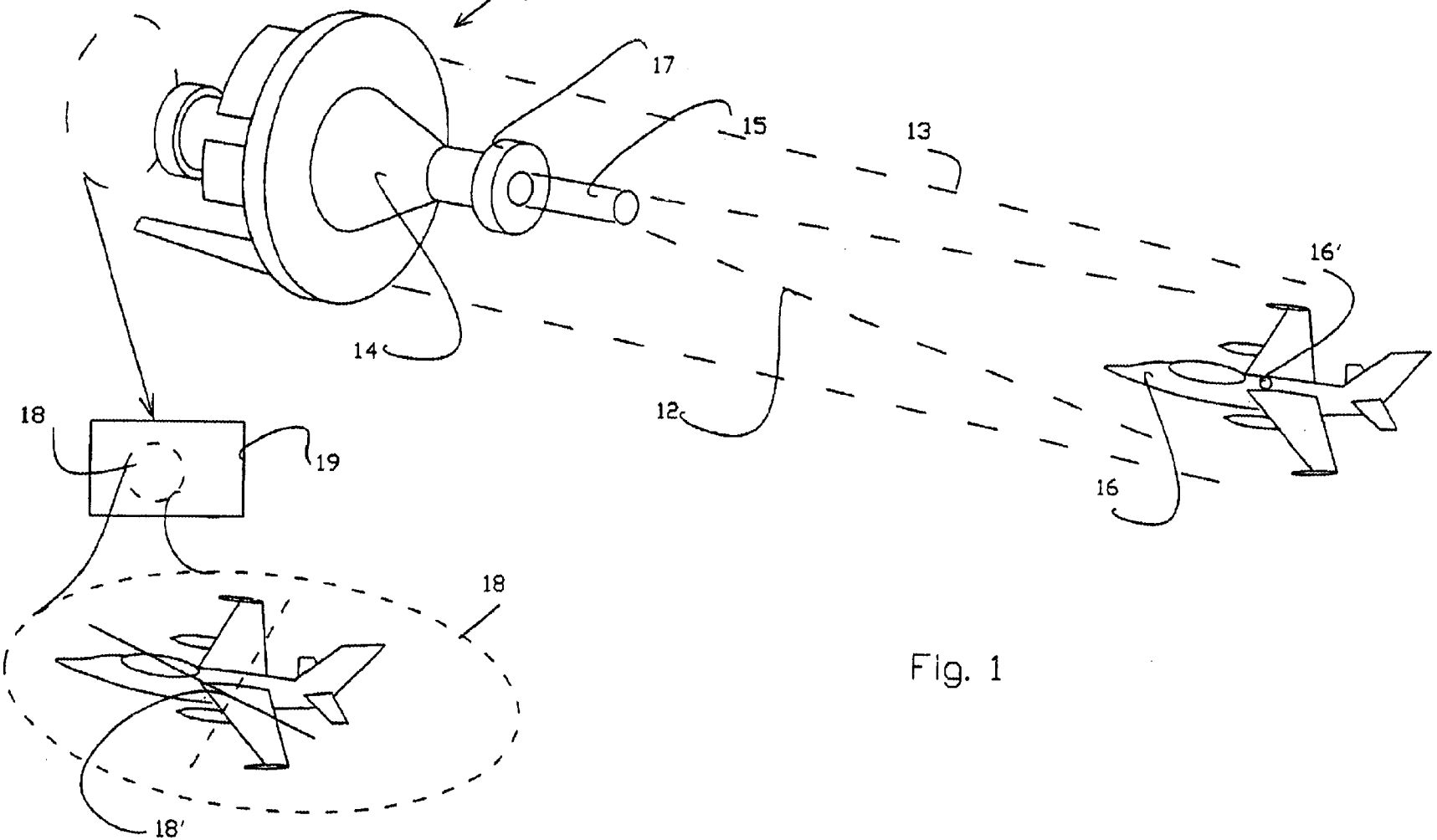
FIG. 1 shows a view of the active laser imagery system acquiring an airborne target.

The present embodiments herein are not intended to be exhaustive and to limit in any way the scope of the invention, rather they are used as examples for the clarification of the invention and for enabling of other skilled in the art to utilize its teaching.

The purpose of the invention is to provide or to improve the "hit to kill" feasibility of an intercepting missile, accordingly the invention includes several aspects, one of which is to provide an aimpoint which is associated with a valid target only.

This is accomplished by fast acquiring of an image of the airborne target at a resolution, which will suffice for an algorithm of the seeker to recognize the nature of target, to define its boundaries and to select an aim point with respect to the image of the target.

This assures that the approaching missile will not be distracted from the target by decoy countermeasure means or spurious signals, which do not have an image of a certified target. Furthermore such a selected aiming point (in the image) provides a stable homing point (on the target) for the missile guiding mechanism, which is always accessible regardless of the relative position of the missile and the target, in contrast to e.g. an hot spot which may some times become hidden or ambiguous.

Consequently, a consistent steering of the missile toward such an homing point will result in a direct hit.

An optical image of an object can be acquired at different wavelength using various imaging techniques, each having its advantages and drawbacks.

The present invention uses active laser imagery, i.e. an image of the target is constructed by collecting the light, which is reflected from the target which is illuminated by a laser.

Active laser imaging and range finding systems are known in the art as laser radar (ladar) systems, which are substantially laser distance meters whose laser beam is scanned to raster at high speed a scene at some solid view angle.

By knowing the two polar angles of a reflecting point vector together with its distance, it is then possible to generate range and three dimension (3D) images over large structures in short times.

Scanning ladar systems use a single detecting element whose output is synchronized with the scanner. Such a system is described e.g. in U.S. Pat. No. 5,940,170 to Berg, et al.

The need for a scanner can be eliminated by using a more powerful laser whose beam can be spreaded and a detector array on which the entire scene is imaged simultaneously. Typical of such detector arrays are CCD arrays, which are available with hundreds or even thousands of pixels on a side. They convert incoming photons into electrical charge with reasonably high efficiency (generally more than 20%), which is stored within the detector element until read out.

Such detectors are suitable for forming an intensity image. However, as they integrate the incoming light, they are not suitable for direct determination of the phase shift of the modulation of the reflected signal and thus can not provide range or 3D images.

A Scannerless ladar employing focal plane detector arrays to obtain a three dimensional images of objects in field of view is disclosed in U.S. Pat. No. 5,877,851 by Stann, et al. Hence nowadays an advanced scannerless ladar with a staring focal plane detector array can be operated at three different modes: Range image mode, intensity image mode and 3D photographic mode which combines the first two modes.

The present invention employs a ladar system, either a scanning or a scannerless one, in its simplest operational mode, which is the image intensity mode, to construct a two dimension (2D) image of a target, although more sophisticated imaging modes can be used too.

Figure 2:
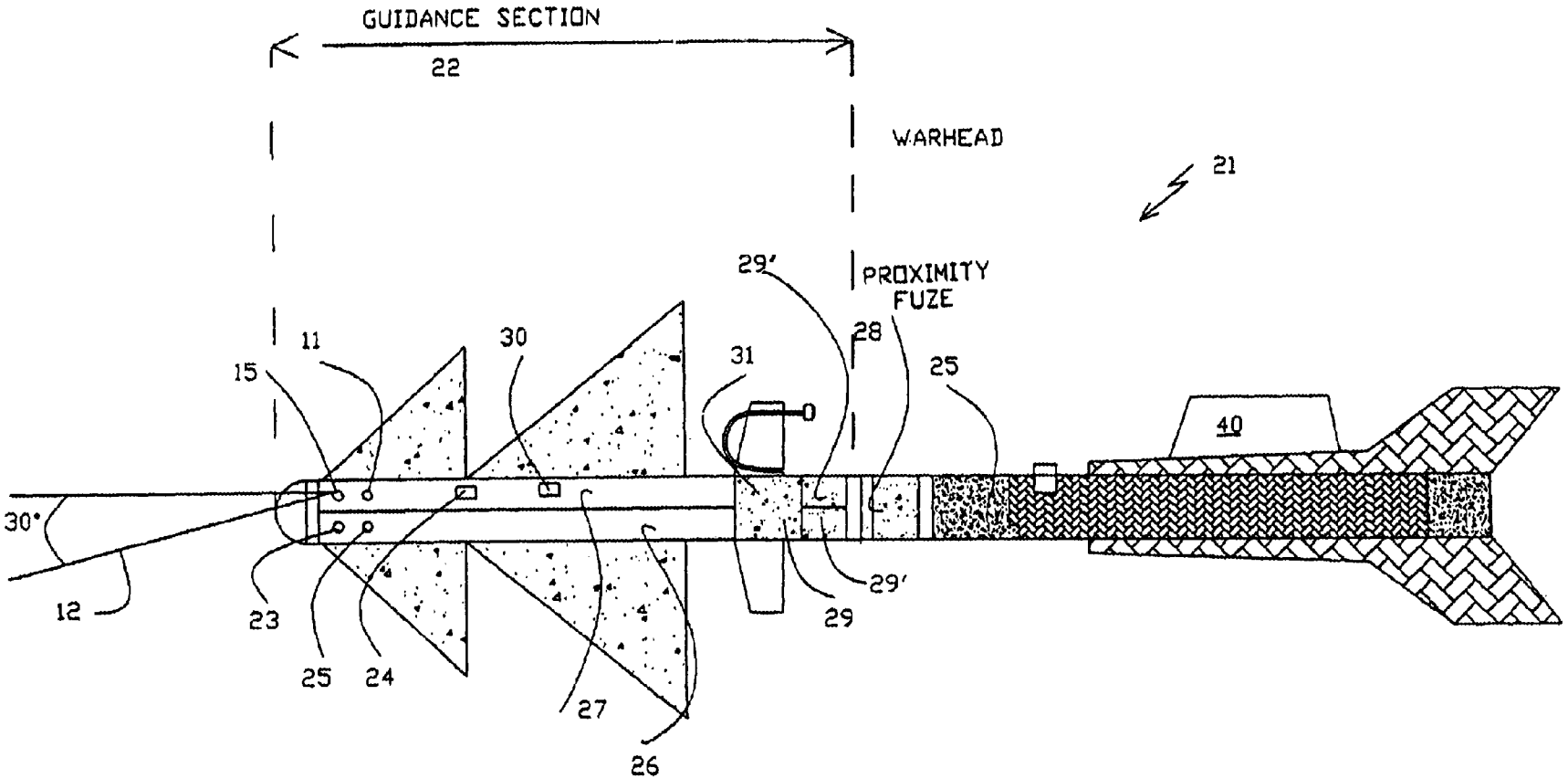
FIG. 2 shows a view of an intercepting missile useful in explaining the present invention.

A drawing of an operating ladar system according to the present invention is shown in FIG. 1. In FIG. 1 an active imaging ladar device 11 which is positioned in the nose of an intercepting missile (shown in FIG. 2) and protected by a transparent window (not shown) includes a scannerless laser 15 which sends a beam of light 12 having a divergence of about 3° in an anticipated direction of a target 16 which up to this point was tracked by a conventional guidance system, heat seeker 22 or radar 23 which are shown in FIG. 2.

Portion 13 of the energy of the illuminating beam 12 is reflected back toward ladar device 11 and is collected by a suitable optical collector 14 e.g. a parabolic mirror which focuses the image on the pixels of a focal plane detector array 17 whose output 19 is used to produces a two dimension intensity image 18 of target 16.

A selected aimpoint 18' in the image 18 corresponds to the updated homing point 16' for the missile (shown in FIG. 2) on target 16.

As the relative position of the missile and target 16 may change very fast, it should be clear that the two important requirements for a ladar homing system for an intercepting missile are update rate and instant field-of-view (FOV).

Update rate is defined as the rate in which the detector array and the signal processor of the homing device can respond to an image contour or location change and calculate a new aimpoint 18'. This rate should be high as possible to assure the direct hit of the missile on target 16. When the relative velocity of the target 16 and the missile are known the update can be expressed in terms of distance.

FOV is the view angle, that within its boundaries objects are seen by the staring focal detector array 17 of the ladar device, FOV should be wide enough in order that a maneuvering target cannot escape from being viewed by the active imagery device even at a very close range.

When a scannerless ladar is used, the effective FOV of the concentric detector array is actually determined by the divergence angle of the laser beam.

Laser 15 of the ladar system is usually a solid state diode laser operating either in a continuous or a pulsed mode but other laser system e.g. a gas laser can be used as well. The wavelength of laser 15 can be in the visible, near IR (1–3 micrometer), mid IR (3–8 micrometer) or far IR (8–12 micrometer).

The detectors of focal plane array 17 are fast solid state devices responsive to the wavelength of the laser illumination such as CCD's, photodiodes, photoconductors or photomultipliers. The light sensitive surface of the detectors is covered with a narrow band-width optical filter transmitting exclusively in the wavelength of the laser illumination, hence the system is affected by neither ambient background illumination or decoy countermeasure radiation, nor by temperature or color of the target.

The way in which the system operates is explained by the following non limiting example with conjunction to FIG. 2:

The intercepting missile 21, can be launched from any site on which a launcher may be located, e.g. from an air vehicle, from a sea vehicle and from a ground based station. Missile 21 has a guidance section 22 which includes two guidance mechanisms: a primary seeker/guidance system 26, which is based on an infra-red seeker, on a radar or on a data link unit 23, and an active imagery guidance system 27 which is base on the active laser imagery system 11 which was shown in FIG. 1.

Primary guidance system 26 brings intercepting missile 21 to within a range of about one to two kilometers from the tracked airborne target.

At such a range when the seeker is heading toward the target, a laser of the active laser imagery system 11 is activated and sends ahead a beam of light 12 having a solid divergence angle of about 3° (which at a distance of 2 km from the missile illuminates roughly a scene area having a diameter of about 100 meters).

At this stage, as was explained and shown in FIG. 1 before, reflections of laser beam 12 from objects residing within the solid angle of laser beam 12 are collected by optics 14 of active laser imagery system 11 to produce an optical image of target 16 on the light sensitive surface of focal plane detector array 17 whose output construct a charge image (or other electronic image known in the art) of target 16.

In this mode of operation the output of each of the elements of detector array 17 depends only on the intensity of the impinging light, thus such a detection mode yields an "electronic intensity image" which corresponds to a two dimensional optical image of target 16.

As said before, also more sophisticated electronic images, which correspond to range images and photo 3D images can be formed.

An algorithm running in an attached processor in the electronic assembly 30 of the missile may then perform a "target validation" if needed, E.g. it decides whether the acquired electronic image conforms to a possible 2D projection of a "certified" target.

In this case, if target validation fails the active laser imagery guidance system disregards the target and primary guidance control continues. However, if validation is positive or in case where it is not performed at al, an aimpoint 18' is selected over the target image. Aaimpoint 18' is generally the calculated center of gravity of intensity 2D image 18, but can also consist of another special point of the image.

Gguidance control is then transferred by a transfer mechanism 31, from primary guidance system 26 to active laser imagery guidance system 27 which by means of proportional navigation completes the steering of the missile to an homing point which is the anticipated colliding point between missile 21 and target 18 according to a computationally collision course of the missile 21 with aimpoint 18'.

Preferentially the intercepting missile should score a direct hit and kill the target due to the imparted impact, thus the desired body to body contact between the missile and the target should not be perturbed by an earlier detonation of the missile's warhead.

Thus, in case that missile 21 is equipped with a warhead 25 and a proximity fuse 28 to activate warhead 25, prior to or simultaneously with guidance transfer which was described above, the fuzing circuit of a proximity fuse 28 of missile 21 is either deactivated or reset to activate a warhead 25 of missile 21 at a zero distance from target.

While the invention has been described with respect to a limited number of embodiments, it will be appreciated that many variations, modifications and other applications of the invention may be made without departing from the spirit and scope of the invention.

What is claimed is:

1. A method for guiding an intercepting missile to a body-to-body contact with an airborne target in the atmosphere, the method comprising the steps of:

(a) guiding the intercepting missile to within an appropriate distance from the airborne target;

(b) illuminating the airborne target, using an illuminator carried by the intercepting missile;

(c) acquiring an image of said illuminated airborne target and, (d) steering said missile in accordance with an aimpoint on said image.

2. The method as in claim 1 further comprising the step of:

(e) launching said intercepting missile from a launcher selected from the group consisting of an aircraft launcher, a sea vehicle launcher and a ground stationed launcher.

3. The method as in claim 1 wherein said appropriate distance is between about 10 meters and about 3 kilometers.

4. The method as in claim 1 wherein said illuminator includes a laser.

5. The method as in claim 4 wherein said laser is a component of a laser radar.

6. The method as in claim 5 wherein said laser radar is a scanning laser radar.

7. The method as in claim 5 wherein said laser radar is a scannerless laser radar.

8. The method as in claim 5 wherein said steering is controlled by a steering system slaved to said laser radar.

9. The method as in claim 8 further comprising the steps of:

(e) transferring guidance control of said intercepting missile from said primary guidance system to said laser radar slaved steering system.

10. The method as in claim 4 wherein said laser is a continuous power laser.

11. The method as in claim 4 wherein said laser is a pulsed power laser.

12. The method as in claim 4 wherein said laser emits light having a wavelength between about 400 nanometers and about 12 micrometers.

13. The method as in claim 4 wherein said laser emits a beam of light having a divergence of at least about 3°.

14. The method as in claim 4 wherein said acquiring is accomplished using a focal plane detector array having detectors selected from the group consisting of CCDs, photodiodes, photoconductors and photo-multipliers.

15. The method as in claim 14, wherein said focal plane detector array is responsive to light at a wavelength of between about 400 nanometers and about 12 micrometers.

16. The method as in claim 14 wherein said focal detector array has an instant field-of-view of at least as wide as a divergence of a laser beam of said laser.

17. The method as in claim 1 wherein said image is selected from the group consisting of an intensity image, a range image and a three dimensional image.

18. The method as in claim 1 wherein said guiding is controlled by a primary guidance system.

19. The method as in claim 18 wherein said primary guidance system is selected from the group consisting of a self-guidance system and a ground radar.

20. The method as in claim 19 wherein said self-guidance system includes a target seeker which is selected from the group consisting of an infra-red seeking sensor and a radar.

21. The method as in claim 1 wherein said aimpoint is a center of gravity of said image.

22. The method as in claim 21 wherein said aimpoint corresponds to an homing point to said intercepting missile on said airborne target.

23. The method as in claim 1 wherein said intercepting missile is provided with a warhead and a proximity fuse to detonate the warhead, the method further comprises the steps of:

(п) deactivating said proximity fuse and, (f) detonating said warhead when the body-to-body contact occurs.

24. The method as in claim 1 wherein said intercepting missile is provided with a warhead and a proximity fuse to detonate the warhead at a predetermined activation distance, the method further comprises the steps of:

(e) resetting said predetermined activation distance of said proximity fuse to zero.

25. An active imagery guidance system mounted on an intercepting missile for guiding the intercepting missile to a body-to-body contact with an airborne target in the atmosphere, the system comprising:

(a) an active imagery system to acquire an image of the airborne target;

(b) a mechanism to calculate an aimpoint on said image and, (c) a steering mechanism to steer said intercepting missile in accordance with said aimpoint.

26. The active imagery guidance system as in claim 25 wherein said active imagery system including:

(i) an illuminator to illuminate the airborne target;

(ii) a focal plane detector array to collect reflected illumination from the airborne target and, (iii) a processor to construct said image according to an output of said focal plane detector array.

27. The active imagery system as in claim 26 wherein said illuminator includes a laser.

28. The active imagery system as in claim 27 wherein said laser is a continuous power laser.

29. The active imagery system as in claim 27 wherein said laser is a pulsed power laser.

30. The active imagery system as in claim 27 wherein said laser is included in a laser radar.

31. The active imagery system as in claim 30 wherein said laser radar is a scanning laser radar.

32. The active imagery system as in claim 30 wherein said laser radar is a scannerless laser radar.

33. The system as in claim 27 wherein said laser emits light in wavelength between about 400 nanometers and about 12 micrometers.

34. The active imagery system as in claim 27 wherein said laser emits a beam of light having a divergence of at least about 3°.

35. The active imagery system as in claim 27 wherein said focal detector array has an instant field-of-view of at least as wide as a divergence of a light beam emitted by said laser.

36. The active imagery system as in claim 26 wherein said focal plane detector array includes detectors selected from the group consisting of CCDs, photodiodes, photoconductors and photo-multipliers.

37. The active imagery system as in claim 26 wherein said focal plane detector array is responsive to light at a wavelength of between about 400 nanometers and about 12 micrometers.

38. The active imagery system as in claim 26 wherein said aimpoint is a center of gravity of said image.

39. The active imagery system as in claim 38 wherein said aimpoint corresponds to a homing point to said intercepting missile on said airborne target.

40. The active imagery system as in claim 25 wherein said image is selected from the group consisting of an intensity image, a range image and a three dimensional image.

41. A hit to kill airborne target intercepting missile operating in the atmosphere comprising:

(a) a primary guidance system to guide the intercepting missile to within an appropriate distance from an airborne target and, (b) an active imagery guidance system to guide the intercepting missile to a body-to-body contact with said airborne target.

42. The intercepting missile as in claim 41 wherein said primary guidance system includes a self-guidance system on board said missile.

43. The intercepting missile as in claim 42 wherein said self-guidance system includes a target seeker which is selected from the group consisting of an infra-red seeking sensor and a radar.

44. The intercepting missile as in claim 41 wherein said appropriate distance is between about 10 meters and about 3 kilometers.

45. The intercepting missile as in claim 41 wherein the active imagery guidance system includes:

(I) an active imagery system to acquire an image of an airborne target;

(II) a mechanism to calculate an aimpoint on said image and, (III) a steering mechanism to steer said intercepting missile in accordance with said aimpoint.

46. The intercepting missile as in claim 45 wherein said active imagery system includes:

(i) an illuminator to illuminate said airborne target;

(ii) a focal plane detector array to collect reflected illumination from said airborne target and, (iii) a processor to construct an image according to an output of said focal plane detector array.

47. The intercepting missile as in claim 46 wherein said illuminator includes a laser.

48. The intercepting missile as in claim 47 wherein said laser is a continuous power laser.

49. The intercepting missile as in claim 47 wherein said laser is a pulsed power laser.

50. The intercepting missile as in claim 47 wherein said laser is included in a laser radar.

51. The intercepting missile as in claim 50 wherein said laser radar is a scanning laser radar.

52. The intercepting missile as in claim 50 wherein said laser radar is a scannerless laser radar.

53. The intercepting missile as in claim 47 wherein said laser emits light in wavelength between about 400 nanometers and about 12 micrometers.

54. The intercepting missile as in claim 47 wherein said laser emits a beam of light having a divergence of at least about 3°.

55. The intercepting missile as in claim 47 wherein said focal detector array has an instant field-of-view of at least as wide as a divergence of a light beam emitted by said laser.

56. The intercepting missile as in claim 46 wherein said focal plane detector array includes detectors selected from the group consisting of CCDs, photodiodes, photoconductors and photo-multipliers.

57. The intercepting missile as in claim 46 wherein said focal plane detector array is responsive to light at a wavelength of between about 400 nanometers and about 12 micrometers.

58. The intercepting missile as in claim 45 wherein said image is selected from the group consisting of an intensity image, a range image and a three dimensional image.

59. The intercepting missile as in claim 45 wherein said aimpoint is a center of gravity of said image.

60. The intercepting missile as in claim 45 wherein said aimpoint corresponds to an homing point of said intercepting missile on said airborne target.

61. The intercepting missile as in claim 41 further comprising:

(c) a mechanism for transferring guidance control of a flight path of the intercepting missile from said primary guidance system to said active imagery guidance system.

62. The intercepting missile as in claim 41 wherein said intercepting missile is provided with a warhead and a proximity fuse to detonate the warhead, the intercepting missile further comprising:

(c) a mechanism for deactivating said proximity fuse and, (d) a mechanism for detonating said warhead when a body-to-body contact is formed between said intercepting missile and said airborne target.

63. The intercepting missile as in claim 41 wherein said intercepting missile is provided with a warhead and a proximity fuse to detonate the warhead at a predetermined activation distance, the intercepting missile further comprising:

(c) a mechanism for resetting said predetermined activation distance of said proximity fuse to zero.

64. A hit to kill airborne target intercepting missile system operating in the atmosphere comprising:

(a) a launching sub system to launch the intercepting missile;

(b) a primary guidance system to guide the intercepting missile to within an appropriate distance from an airborne target and, (c) an active imagery guidance system to guide the intercepting missile to a body-to-body contact with said airborne target.

65. The intercepting missile system as in claim 64 wherein a launcher of said launching sub system is selected from the group consisting of an aircraft launcher, a sea vehicle launcher and a ground stationed launcher.

* * * * *